US011027159B2

(12) United States Patent
Kim et al.

(10) Patent No.: US 11,027,159 B2
(45) Date of Patent: Jun. 8, 2021

(54) WATER CURTAIN HEAD FOR PREVENTING FIRE SPREAD BETWEEN FLOORS IN CURTAIN WALL BUILDING

(71) Applicants: Paratech Company Limited, Bucheon-si (KR); Korea Fire Industry Technology Institute, Yongin-si (KR); Chung Ang University Industry Academic Cooperation Foundation, Seoul (KR)

(72) Inventors: Dongjoon Kim, Seoul (KR); Junseok Nam, Incheon (KR); Hongsun Ryou, Yongin-si (KR)

(73) Assignees: Paratech Company Limited, Gyeonggi-do (KR); Korea Fire Industry Technology Institute, Gyeonggi-do (KR); Chung Ang University Industry Academic Cooperation Foundation, Seoul (KR)

( * ) Notice: Subject to any disclaimer, the term of this patent is extended or adjusted under 35 U.S.C. 154(b) by 66 days.

(21) Appl. No.: 16/094,674

(22) PCT Filed: Nov. 1, 2016

(86) PCT No.: PCT/KR2016/012450
§ 371 (c)(1),
(2) Date: Oct. 18, 2018

(87) PCT Pub. No.: WO2017/183782
PCT Pub. Date: Oct. 26, 2017

(65) Prior Publication Data

US 2019/0060688 A1 Feb. 28, 2019

(30) Foreign Application Priority Data

Apr. 22, 2016 (KR) ..... 10-2016-0049601

(51) Int. Cl.
*A62C 31/02* (2006.01)
*A62C 2/08* (2006.01)
(Continued)

(52) U.S. Cl.
CPC ..... *A62C 31/02* (2013.01); *A62C 2/08* (2013.01); *A62C 35/68* (2013.01); *A62C 37/08* (2013.01)

(58) Field of Classification Search
CPC .. A62C 31/02; A62C 2/08; A62C 2/06; A62C 35/68; A62C 37/08; A62C 3/0257; A62C 3/0264; A62C 31/05
(Continued)

(56) References Cited

U.S. PATENT DOCUMENTS 316,581 A * 4/1885 Stratton ..... A62C 31/02 169/37
5,865,256 A * 2/1999 Pounder ..... A62C 31/02 169/37
(Continued)

FOREIGN PATENT DOCUMENTS

JP 2001-238977 A 9/2001
KR 2006-0019384 A 3/2006
(Continued)

OTHER PUBLICATIONS

International Search Report PCT/ISA/210 for International Application No. PCT/KR2016/012450 dated Feb. 20, 2017.
(Continued)

*Primary Examiner* — Qingzhang Zhou
*Assistant Examiner* — Christopher R Dandridge
(74) *Attorney, Agent, or Firm* — Harness, Dickey & Pierce, P.L.C.

(57) ABSTRACT

A water curtain head according to the present invention may comprise: a head body which is connected to a water supply
(Continued)

pipe installed in an inner side of a building and has a water-releasing opening; and a deflector arranged adjacent to the water-releasing opening to allow water discharged by the water-releasing opening to pass therethrough. The deflector may comprise: a first spray nozzle formed on the front surface of the deflector to penetrate the front surface of the deflector; and a second spray nozzle formed to be recessed inward from a side surface of the deflector by a predetermined section.

10 Claims, 8 Drawing Sheets

(51) Int. Cl.
*A62C 35/68* (2006.01)
*A62C 37/08* (2006.01)

(58) Field of Classification Search
USPC ..... 239/569
See application file for complete search history.

(56) References Cited

U.S. PATENT DOCUMENTS

| | | | | |
|---|---|---|---|---|
| 2011/0030977 | A1* | 2/2011 | Polan | A62C 35/58 169/37 |
| 2015/0224351 | A1* | 8/2015 | Chen | A62C 37/14 169/57 |

FOREIGN PATENT DOCUMENTS

| | | | | | |
|---|---|---|---|---|---|
| KR | 2013-0014951 | A | | 2/2013 | |
| KR | 20130014951 | | * | 2/2013 | A62C 31/02 |
| KR | 10-1279525 | | | 7/2013 | |
| KR | 2013-0090239 | A | | 8/2013 | |
| WO | WO-2014-158003 | A1 | | 10/2014 | |

OTHER PUBLICATIONS

Written Opinion of the International Searching Authority PCT/ISA/237 for International Application No. PCT/KR2016/012450 dated Feb. 20, 2017.
Korean Office Action for Korean Application No. 10-2016-0049601 dated Jun. 21, 2017.

* cited by examiner

WATER CURTAIN HEAD FOR PREVENTING FIRE SPREAD BETWEEN FLOORS IN CURTAIN WALL BUILDING

CROSS-REFERENCE TO RELATED APPLICATION

This application is the National Stage filing under 35 U.S.C. 371 of International Application No. PCT/KR2016/012450, filed on Nov. 1, 2016, which claims the benefit of earlier filing date and right of priority to Korean Application No. 10-2016-0049601, filed on Apr. 22, 2016, the contents of which are all hereby incorporated by reference herein in their entirety.

BACKGROUND OF THE INVENTION

1. Field of the Invention

The present disclosure relates to a water curtain head and, more particularly, to a water curtain head applied to a curtain wall building.

2. Description of the Related Art

In curtain wall buildings, glass windows for securing a view and functioning as indoor lighting based on sunlight are installed on walls.

A curtain wall refers to a member in which a structure (frame) and a member (mainly, glass windows such as glass, stone, other finishing materials, etc.) constituting an outer elevation surface is separated like a curtain to cover a building.

Curtain wall types may be classified according to structural schemes as follows. A mullion type is a scheme in which vertical columns are exposed and sashes or spandrel panels are inserted therebetween. A panel scheme (or spandrel type) is a scheme configured by a combination of a panel emphasizing a horizontal line and an inner glass window. A sheathed type is a scheme in which a chassis is hidden in a panel so that a structure is not visible to the outside, and a grid type is a scheme of illustrating a vertical and horizontal grid appearance.

The curtain wall system has emerged as a main constituent, rather than a simple outer covering decoration of skyscrapers, but, in terms of structural characteristics of the curtain wall structure, a fire or smoke may be spread through a space between a glass window and the floor (pork-through phenomenon) or through a broken portion of a glass window (leaf-frog phenomenon), leading to a possibility that the fire is spread between floors.

SUMMARY OF THE INVENTION

The present disclosure is to solve the above-mentioned problems and other problems.

An object of the present disclosure is to provide a water curtain head having various spray directions to simultaneously spray water to glass windows and the inside of a building.

According to an aspect of the present disclosure, there is provided a water curtain head including: a head body connected to a water supply pipe installed inside a building and having a water releasing opening; and a deflector disposed to be adjacent to the water releasing opening to allow water discharged by the water releasing opening to pass therethrough, wherein the deflector includes a first spray nozzle formed on a front surface of the deflector to penetrate through the front surface; and a second spray nozzle depressed inwards from a side surface of the deflector by a predetermined section.

In an embodiment, the deflector may have a disk shape, the second spray nozzle may include a plurality of spray nozzles, and the plurality of spray nozzles may be formed in a circumferential direction of the disk.

In an embodiment, the plurality of spray nozzles may be formed only in a partial region of the circumference of the disk.

In an embodiment, a sloped portion may be formed on a rear surface of the deflector such that a thickness of the deflector is increased from the center toward the edge.

In an embodiment, the head body may include a first body and a second body formed in a direction perpendicular to the first body and having the water releasing opening.

In an embodiment, the head body may be provided in the frame, and the frame may have a bent portion formed on at least a portion to correspond to a shape of the first and second bodies.

In an embodiment, a stopper may be disposed on the opposite side of the water releasing opening of the second body, and the stopper may be coupled to the frame.

In an embodiment, a connection portion connected to the frame may be formed on a rear surface of the deflector.

The water curtain head may further include: a first cap connected to the deflector; a second cap disposed at the water releasing opening to close the water releasing opening; and a heat sensing portion configured to sense heat and disposed between the first and second caps.

According to another aspect of the present disclosure, there is provided a water curtain head including: a head body connected to a water supply pipe installed inside a building and having a water releasing opening; a deflector having a spray nozzle allowing water discharged by the water releasing opening to pass therethrough; a heat sensing portion disposed between the head body and the deflector; and a heat sensing hole covering the head body and having a heat sensing hole formed at a position corresponding to the spray nozzle.

In an embodiment, the cover may be coupled to a first fixing portion, and the cover may be coupled to the first fixing portion by a heat sensing alloy such that the cover is separated from the first fixing portion when the ambient temperature of the cover is equal to or higher than a predetermined temperature.

In an embodiment, a hook may be formed on at least one of the first and second fixing portions and a recess may be formed on the other to allow the hook to be hooked therein so that the first and second fixing portions are coupled to each other.

According to another aspect of the present disclosure, there is provided a curtain wall water curtain head system applied to a curtain wall building including: a curtain wall; and a water curtain head installed to be adjacent to the curtain wall, wherein the front surface of the deflector faces the curtain wall such that water sprayed through the first spray nozzle is oriented toward the curtain wall.

In the water curtain head according to the present disclosure, since a first spray nozzle and a second spray nozzle are formed on a front surface and a side surface of the deflector, water may be spread forwards, sidewards (or downwards) from the deflector.

In addition, when the front surface of the deflector is installed to face the curtain wall, water may be simultaneously sprayed to the curtain wall and the inside of a building, significantly reducing the possibility that a fire spreads to a space between floors.

DETAILED DESCRIPTION OF THE INVENTION

Hereinafter, the embodiments of the present invention will be described with reference to the accompanying drawings, in which like numbers refer to like elements throughout although the embodiments are different, and a description of the like elements a first embodiment will be used for those of the different embodiment. In the following description, usage of suffixes such as 'module', 'part' or 'unit' used for referring to elements is given merely to facilitate explanation of the present invention, without having any significant meaning by itself. In describing the present invention, if a detailed explanation for a related known function or construction is considered to unnecessarily divert the gist of the present invention, such explanation has been omitted but would be understood by those skilled in the art. The accompanying drawings of the present invention aim to facilitate understanding of the present invention and should not be construed as limited to the accompanying drawings. Also, the present invention is not limited to a specific disclosed form, but includes all modifications, equivalents, and substitutions without departing from the scope and spirit of the present invention.

It will be understood that, although the terms first, second, etc. may be used herein to describe various elements, these elements should not be limited by these terms. These terms are only used to distinguish one element from another.

It is to be understood that when one element is referred to as being "connected to" or "coupled to" another element, it may be connected directly to or coupled directly to another element or be connected to or coupled to another element, having the other element intervening therebetween. Meanwhile, it is to be understood that when one element is referred to as being "connected directly to" or "coupled directly to" another element, it may be connected to or coupled to another element without the other element intervening therebetween.

As used herein, the singular forms "a", "an" and "the" are intended to include the plural forms as well, unless the context clearly indicates otherwise.

It will be further understood that the terms "comprises" "comprising," "includes" and/or "including" when used herein, specify the presence of stated features, integers, steps, operations, elements, and/or components, but do not preclude the presence or addition of one or more other features, steps, operations, elements, components, and/or groups thereof.

Hereinafter, a water curtain head according to the present disclosure will be described with reference to the drawings.

Figure 1:
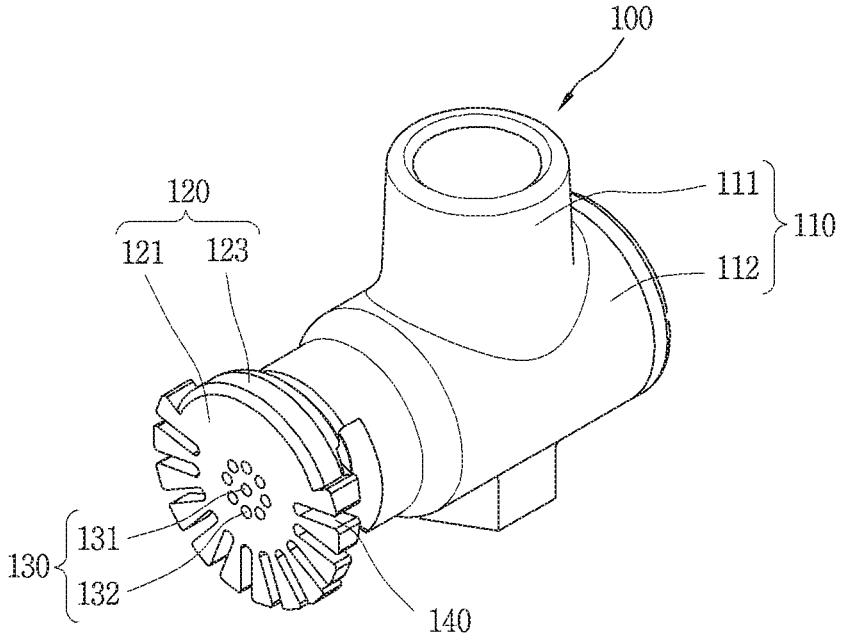
FIG. 1 is a perspective view of a water curtain head according to an embodiment of the present disclosure.
Figure 2:
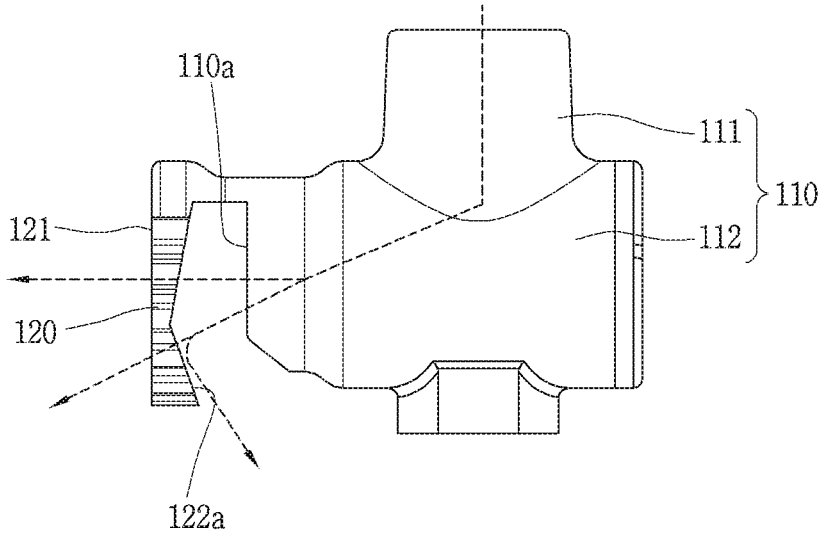
FIG. 2 is a side view of the water curtain head illustrated in FIG. 1 viewed from the side.
Figure 3A:
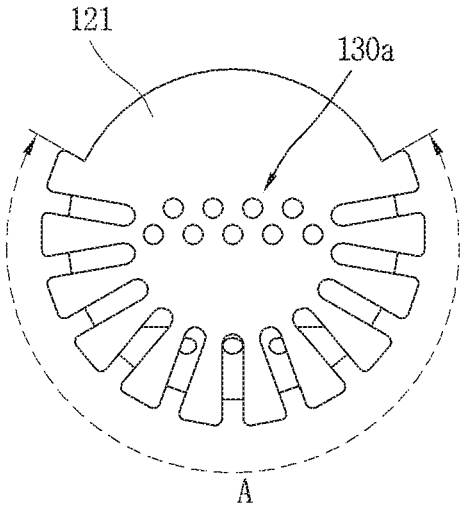
FIGS. 3A and 3B are views for explaining patterns of a first spray nozzle.
Figure 3B:
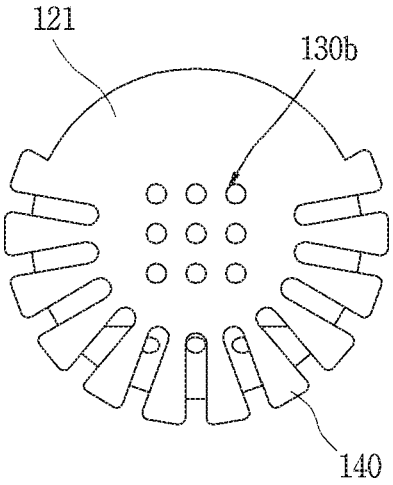

FIG. 1 is a perspective view of a water curtain head according to an embodiment of the present disclosure, and FIG. 2 is a side view of the water curtain head illustrated in FIG. 1. FIGS. 3A and 3B are views for explaining the patterns of a first spray nozzle.

Referring to FIGS. 1 and 2, a water curtain head 100 according to an embodiment of the present disclosure includes a head body 110 and a deflector 120. The water curtain head 100 according to an embodiment may be an open type water curtain head.

A flow path through which water may move is formed in the head body 110. The head body 110 is connected to a water supply pipe installed inside a building so that water may be supplied. In addition, the head body 110 includes a water releasing opening 110*a* to discharge supplied water.

The head body 110 may include first and second bodies 111 and 112. The first and second bodies 111 and 112 may be disposed to be perpendicular to each other. The first and second bodies 111 and 112 may be integrally formed or may be separately formed and subsequently joined together by welding, or the like. Here, the first body 111 may be formed in a vertical shape, and the second body 112 may be formed in a horizontal shape.

Here, a water supply pipe may be connected to one side of the first body 111, and the water releasing opening 110*a* may be formed at one side of the second body 112. According to such a structure, a flow path may be formed from the water supply pipe side to the water releasing opening 110*a* side in the head body 110.

The deflector 120 is configured to spread water discharged from the water releasing opening 110*a* of the head body 110 in all directions.

That is, the deflector 120 may be disposed adjacent to the water releasing opening 110*a* to allow water discharged from the water releasing opening 110*a* to pass therethrough. Specifically, one surface of the deflector 120 may be disposed to face the water releasing opening 110*a*.

The deflector 120 may include a front surface 121, a rear surface 122, and a side surface 123 connecting the front surface and the rear surface. The deflector 120 may include first and second spray nozzles 130 and 140 formed on the front and side surfaces 121 and 123, respectively.

The first spray nozzle 130 penetrates through the front surface 121 of the deflector 120.

Referring to FIG. 1, the first spray nozzle 130 may include a plurality of spray nozzles. The plurality of spray nozzles may be arranged in a specific pattern.

For example, referring to FIG. 1, any one spray nozzle 131 may be formed at the center of a front surface 121 of the deflector 120, and the other remaining spray nozzles 132 may be arranged in a circular shape adjacent to the any one spray nozzle 131.

Referring to FIG. 3A, the plurality of spray nozzles 130*a* forming first spray nozzles may be arranged in a row in one direction. Referring to FIG. 3B, the spray nozzles 130*b* forming first spray nozzles may be arranged in a rectangular shape.

Meanwhile, the second spray nozzle 140 may be formed to be depressed inwards from the side surface at a predetermined interval. In addition, the second spray nozzle 140 may be connected to the front and rear surfaces 121 and 123 as well as the side surface.

The second spray nozzle 140 may include a plurality of spray nozzles.

For example, in the case of the disk-shaped deflector 120, the plurality of spray nozzles 140 may be formed in a circumferential direction of the disk. The plurality of spray nozzles may be spaced apart from each other by a predetermined distance.

Furthermore, the plurality of spray nozzles 140 may be formed only in a portion of the circumference of the disk. In other words, the plurality of spray nozzles may not be formed wholly at the edge of the disk but may be formed only at a portion of the edge of the disk.

In this case, the portion where the plurality of spray nozzles 140 are formed may include a half or more of the circumference of the disk. In other words, the portion may be a portion corresponding to a straight angle or greater of the circumference of the disk.

According to the structure, water passing through the second spray nozzle 140 may be spread to a lower side and a lateral side of the deflector 120. Also, water passing through the first spray nozzle 130 may be spread to a front side of the deflector 120.

In case where a glass window is disposed in front of the deflector 120, water passing through the first spray nozzle 130 generally moves to the glass window and water passing through the second spray nozzle 120 may be spread to the inside of the building. That is, the water curtain head 100 according to the present disclosure may simultaneously spray water to the glass window and the inside of the building through the first and second spray nozzles 130 and 140.

Meanwhile, referring to FIG. 2, a sloped portion 122*a* increased from the center toward the edge may be formed on a lower portion of a rear surface of the deflector 120. The sloped portion 122*a* may be formed on a lower the rear surface of the deflector 120. According to this structure, water flowing along the rear surface may be spread to the rear side of the deflector 120.

Hereinafter, a water curtain head according to another embodiment of the present disclosure will be described with reference to FIGS. 4 and 5. FIG. Here, another embodiment may be a closed type water curtain head.

Figure 4:
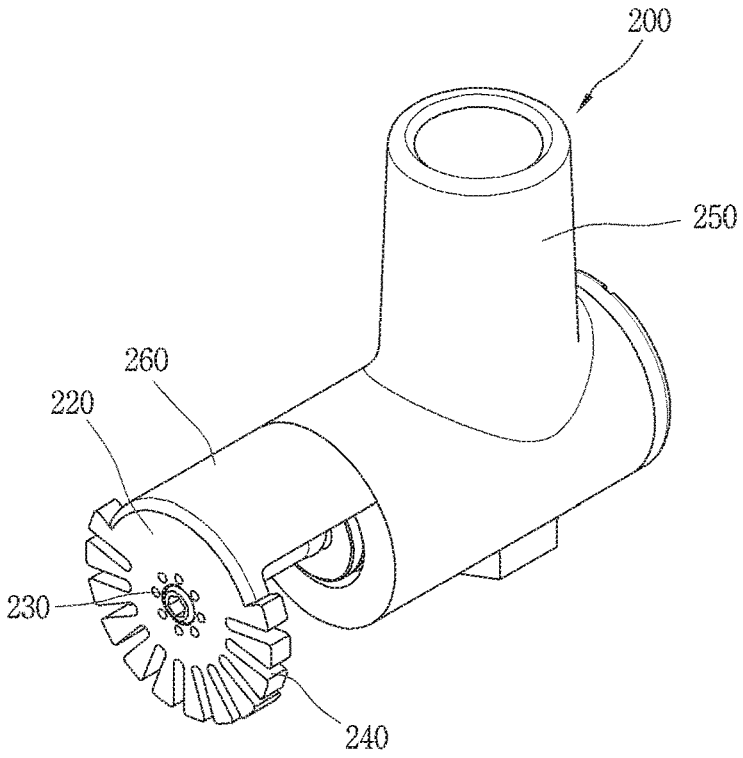
FIG. 4 is a perspective view of a water curtain head according to another embodiment of the present disclosure.
Figure 5:
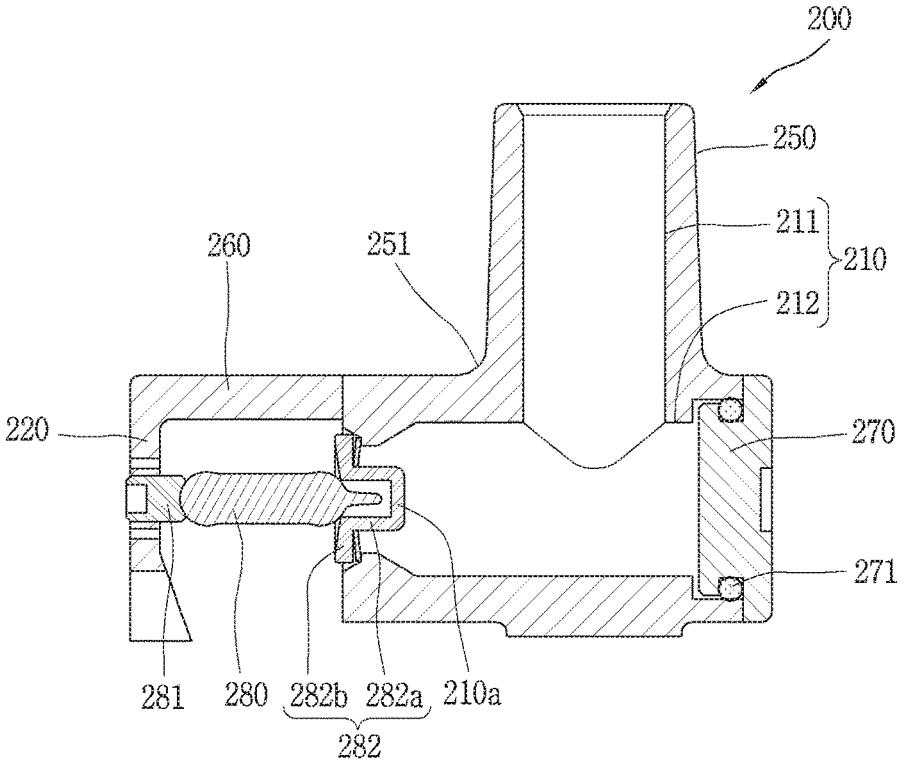
FIG. 5 is a cross-sectional view of a water curtain head according to another embodiment of the present disclosure.

FIG. 4 is a perspective view of a water curtain head according to another embodiment of the present disclosure, and FIG. 5 is a cross-sectional view of a water curtain head according to another embodiment of the present disclosure.

The water curtain head 200 according to another embodiment of the present disclosure may include a frame 250, a head body 210, and a deflector 220.

The head body 210 and the deflector 220 are the same as those described above, and here, a frame 250 will be described.

The frame 250 is formed to cover the head body 210. That is, the head body 210 may be provided inside the frame 250.

The frame 250 may include a bent portion 251 in at least a portion to correspond to an arrangement shape of the first and second bodies 211 and 212 constituting the head body 210. In other words, when the first body 211 is formed in a vertical direction and the second body 212 is formed in a horizontal direction, the bent portion 251 may have a bent shape at an approximately right angle.

Meanwhile, the deflector 220 may be connected to the frame 250. Specifically, a connection portion 260 connected to the frame 250 may be formed on a rear surface of the deflector 220.

The connecting portion 260 may be formed on an area of the rear surface of the deflector 220 where the second spray nozzle 240 is not formed. If the second spray nozzle 240 is formed at a lower portion of the rear surface of the deflector 220, the connecting portion 260 may be formed at an upper portion of the rear surface of the deflector 220. Also, the deflector 220 and the connecting portion 260 may be integrally formed.

Meanwhile, the length of the connecting portion 260 may be determined based on a distance between the deflector 220 and the spray nozzle.

Referring to FIG. 5, a stopper 270 is disposed on the opposite side of the water releasing opening of the second body 212. The stopper 270 may be coupled to the frame 250. A packing member 271 may be disposed between the second body 212 and the stopper 270.

Referring to FIGS. 4 and 5, the water curtain head according to another embodiment of the present disclosure may include a heat sensing portion 280 and first and second caps 281 and 282.

The first cap 281 is connected to the deflector 220. More specifically, the first cap 281 may be disposed on a rear surface of the deflector 220, and at least a portion thereof may penetrate through the deflector 220. In other words, the first cap 281 may be inserted into a recess formed in the deflector 220 so as to be fixed to the deflector 220.

The second cap 282 may be disposed in the water releasing opening to close a water releasing opening 210*a*. More specifically, the second cap 282 may include a first portion 282*a* depressed to an inner side the water releasing opening 210*a* and a second portion 282*b* packing the water releasing opening around an outlet of the water releasing opening. The first and second portions 282*a* and 282*b* may be integrally formed. Also, the second portion 282*b* may be configured to intersect at least a portion of the first portion 282*a*. Meanwhile, the second cap 282 may be formed of a brass material.

The heat sensing portion 280 is configured to sense heat. The heat sensing portion 280 may include a metal heat sensing element or a specific liquid. The heat sensing portion 280 may be configured to be broken when an ambient temperature Is not within a predetermined range.

The heat sensing portion 280 may be disposed between the first and second caps 281 and 282. That is, one side of the heat sensing portion 280 may be in contact with the first cap 281 and the other side may be in contact with the second cap 282. Accordingly, the heat sensing portion 280 may be configured to press the first and second caps 281 and 282.

Referring to an operation of the heat sensing portion 280, when the ambient temperature is not within the predetermined range, the heat sensing portion 280 is broken to release pressure applied to the first and second caps 281 and 282. Accordingly, the first and second caps 281 and 282 may be separated from the deflector 220 and the water releasing opening 210*a*, respectively. Accordingly, water discharged from the water releasing opening 210*a* may be spread in all directions through the deflector 220.

Figure 6:
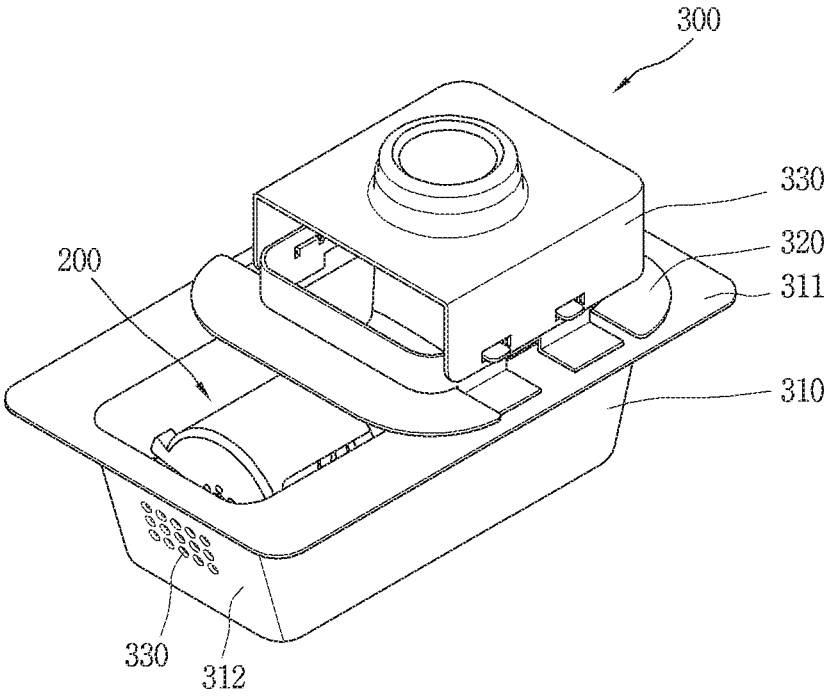
FIGS. 6 to 7 are a perspective view and an exploded view of a water curtain head according to another embodiment of the present disclosure.
Figure 7:
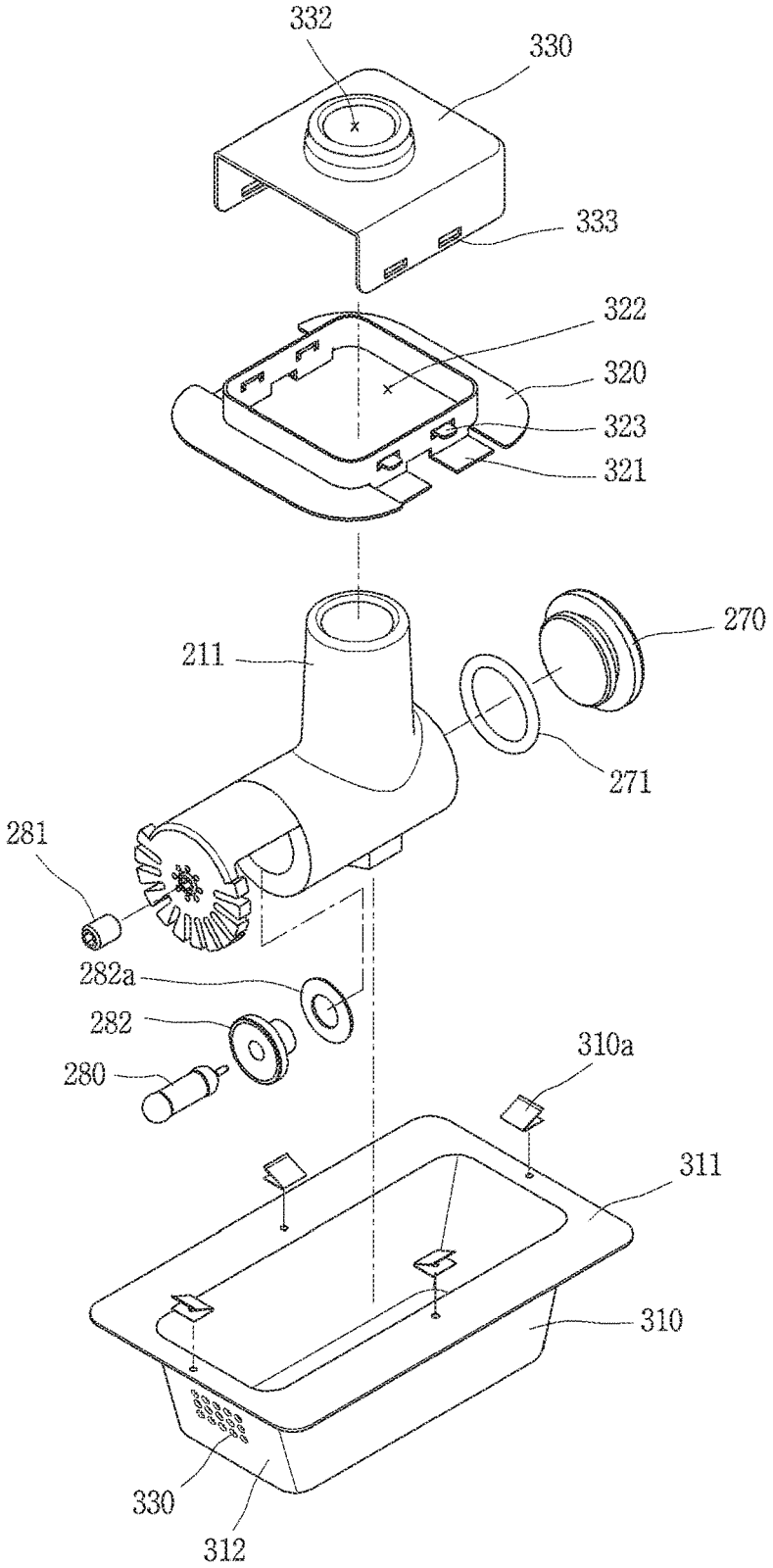
Figure 8:
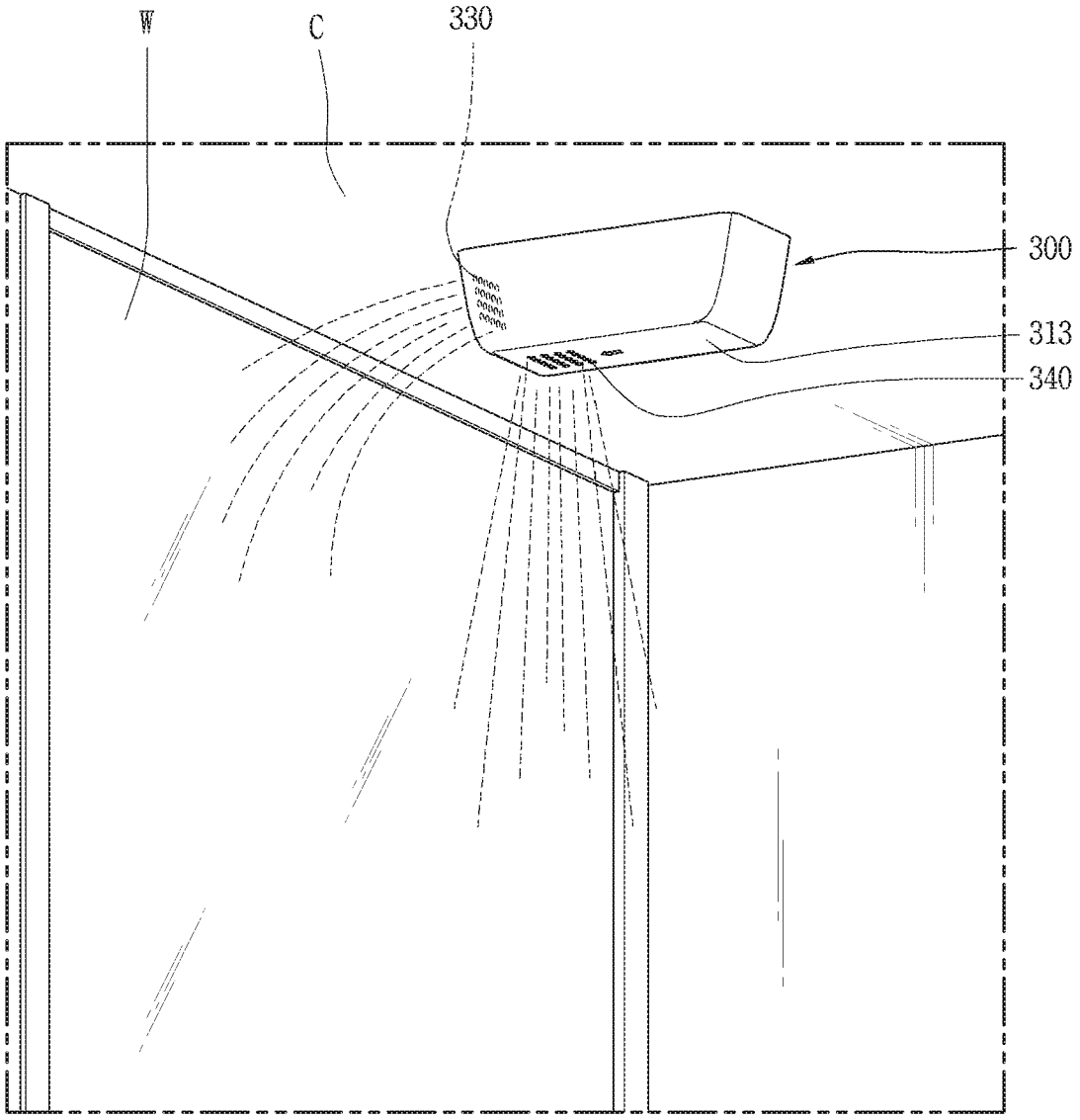
FIG. 8 is a conceptual view illustrating a state of an installed water curtain head according to another embodiment of the present disclosure.

FIGS. 6 to 7 are a perspective view and an exploded view of a water curtain head according to another embodiment of the present disclosure. FIG. 8 is a conceptual view illustrating a state in which a water curtain head is installed according to another embodiment of the present disclosure.

Referring to FIGS. 6 and 7, a water curtain head 300 according to another embodiment of the present disclosure may include a head body 210, a deflector 220, a heat sensing portion 280, and a cover 310.

The head body 210, the deflector 220, and the heat sensing portion 280 have already been described above, and thus, a description thereof will be omitted.

The cover 310 is configured to cover the head body 210. When the head body 210 is present inside the frame, the cover 310 may be configured to cover the frame. The cover 310 may have a hexahedral shape in which one side thereof is open. That is, components such as the head body 21,0 and the like, may be accommodated in the cover 310 through the open side. In addition, a wing portion 311 extends from one surface of the cover 310. The wing portion 311 may serve as an attachment portion when the cover 310 is attached to a ceiling, or the like.

The cover 310 may have a heat sensing hole at a position corresponding to the spray nozzle formed in the deflector 220. In other words, the cover 310 may include first and second heat sensing holes 330 and 340.

The first and second heat sensing holes 330 and 340 may be formed on front and lower surfaces 312 and 313 of the cover 310. In addition, although not shown, a heat sensing hole may be formed on the left and right sides of the cover 310.

Referring to FIGS. 6 and 7, the water curtain head 300 according to the present embodiment may include first and second fixing portions 320 and 330.

The first fixing portion 320 may be coupled to the cover 310. More specifically, the first fixing portion 320 has an auxiliary wing portion 321. The auxiliary wing portion 321 may be in surface contact with the wing portion 311 of the cover 310. The first fixing portion 320 and the cover 310 may be coupled with each other as the auxiliary wing portion 321 and the wing portion 311 are coupled with each other. Meanwhile, the auxiliary wing portion 321 and the wing portion 311 may be adhered to each other by an adhesive member or may be coupled to each other through a separate fastening member.

The cover 310 may be coupled to the first fixing portion 320 by a heat sensing alloy such that the cover 310 is separated from the first fixing portion 320 when an ambient temperature is equal to or higher than a predetermined temperature.

Here, the predetermined temperature may be a temperature corresponding to heat sensed by the heat sensing alloy.

In other words, when the ambient temperature is equal to or higher than the predetermined temperature, the cover 310 may be first released and the heat sensing portion 280 may burst secondarily, resulting in final spraying.

Meanwhile, the first fixing portion 320 may have a first opening portion 322 through which the first body 211 may pass.

The second fixing portion 330 is configured to be coupled with the first fixing portion 320. Specifically, a hook 323 may be formed in the first fixing portion 320, and a recess 333 may be formed in the second fixing portion 330. The first and second fixing portions 320 and 330 may be coupled to each other as the hook 323 caught in the recess 323.

The second fixing portion 330 includes a second opening 332 through which the first body 211 may pass.

An open area of the second opening 332 may be narrower than the area of the first opening portion 322. The second opening 322 may have a shape and size corresponding to a cross-sectional area of the first body 211 to fix the first body 211.

Referring to FIG. 8, the water curtain head 300 according to the present disclosure is mounted on a ceiling C adjacent to the glass window W such that a front surface of the cover 310 (more specifically, the deflector) faces the glass window.

In FIG. 8, it is illustrated that water discharged from the first heat sensing hole 330 is spread to the glass window W and water emitted from the second heat sensing hole 340 is spread to the inside of the building, but the present disclosure is not limited thereto. That is, as described above, when the ambient temperature exceeds a predetermined temperature, the cover is disengaged, and water discharged from the first and second spray nozzles of the deflector may be spread to the glass windows and the inside of the building.

Up to now, the structure of the water curtain head related to the present disclosure has been described. Hereinafter, the effect of the water curtain head related to the present disclosure will be examined through testing of measuring a wall surface (glass window) sprinkling distribution and an interior (building interior) sprinkling amount.

In order to perform testing of measuring the wall surface sprinkling distribution and the interior sprinkling amount, a water curtain head was installed to be spaced apart from the wall surface by about 15 cm and a sprinkling amount of the wall surface and a collected amount of a water collecting container installed on an inner side were measured.

As testing conditions, a water discharge pressure was set to 0.1 MPa, a head mounting height was 1.2 m from the water collecting container, and a measurement time was 1 minute.

The results of the sprinkling distribution test are illustrated in Table 1 below.

TABLE 1

| | E-flush head | Window sprinkler head | First glass curtain wall water curtain head | Second glass curtain wall water curtain head |
|---|---|---|---|---|
| Flow rate coefficient K) | K80 | K80 | K50 | K50 |
| Wall surface sprinkling distance | — | 2.8 | 2.2 | 2/2 |
| Wall surface attainable water amount | 26 | 15 | 20 | 14.5 |
| Inner attainable water amount | 37.1 | 1.25 | 17.4 | 20.7 |
| Ratio of inner side attainable water amount to wall surface attainable water | 3:4 | 12:1 | 8:7 | 2:3 |

Referring to Table 1 above, E-flush head and window sprinkler head are related arts, and first and second glass curtain wall water curtain heads are water curtain heads according to various embodiments of the present disclosure.

Figure 9A:
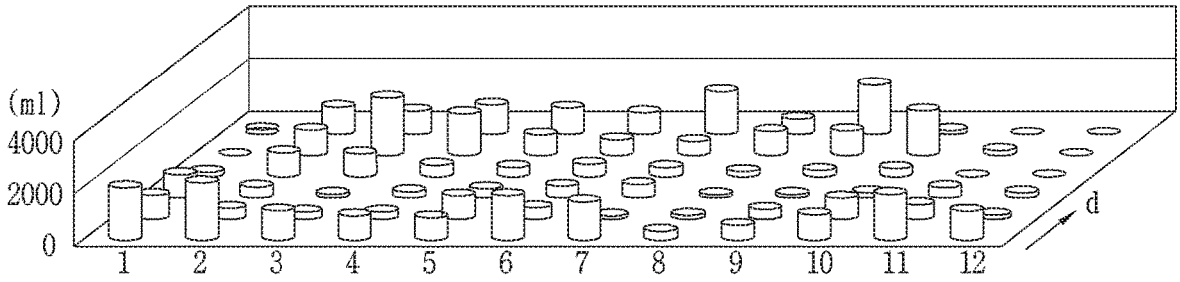
FIGS. 9A, 9B, and 9C are graphs illustrating sprinkling distributions of an E-flush head, a glass window sprinkler head, and a first glass curtain wall water curtain head may water head.
Figure 9B:
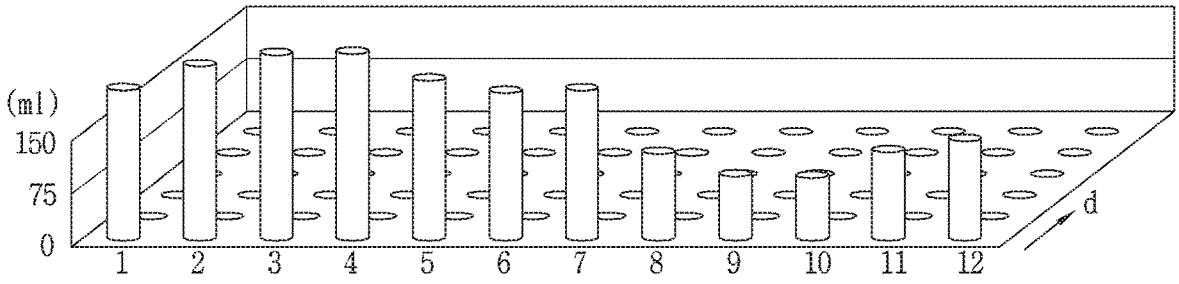
Figure 9C:
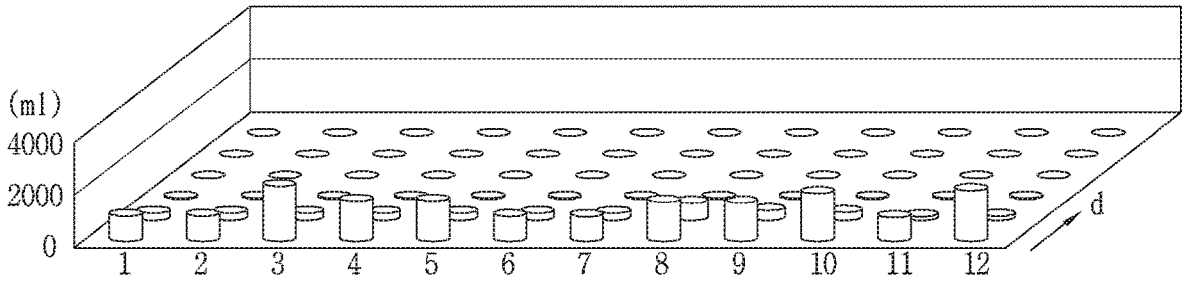

FIGS. 9A, 9B, and 9C are graphs illustrating sprinkling distributions of the E-flush head, the window sprinkler head, and the first glass curtain wall water curtain head. The height of each bar graph may refer to the volume of water (ml) filling each water collecting container. Further, a glass surface is provided parallel to a horizontal axis, and thus, a vertical axis may refer to a distance d from the glass surface.

Referring to FIG. 9A, it can be seen that sprinkling was performed to reach the #5 water collecting container, about 1.5 m away from the glass surface, but the distribution was irregular and the sprinkling radius in the direction of the glass surface was very small.

Referring to FIG. 9B, it can be seen that inner side sprinkling was rarely performed, but the spraying radius was very large in the direction of the glass surface.

Referring to FIG. 9C, it can be seen that inner sprinkling and sprinkling in the direction of the glass surface are performed evenly. It can be seen that a wall surface water discharge amount was about 20,300 ml, a building interior water discharge amount was 22,785 ml, and an effective/maximum sprinkling range was 2.2 m.

Hereinafter, results of a gasoline combustion test will be described.

Figure 10:
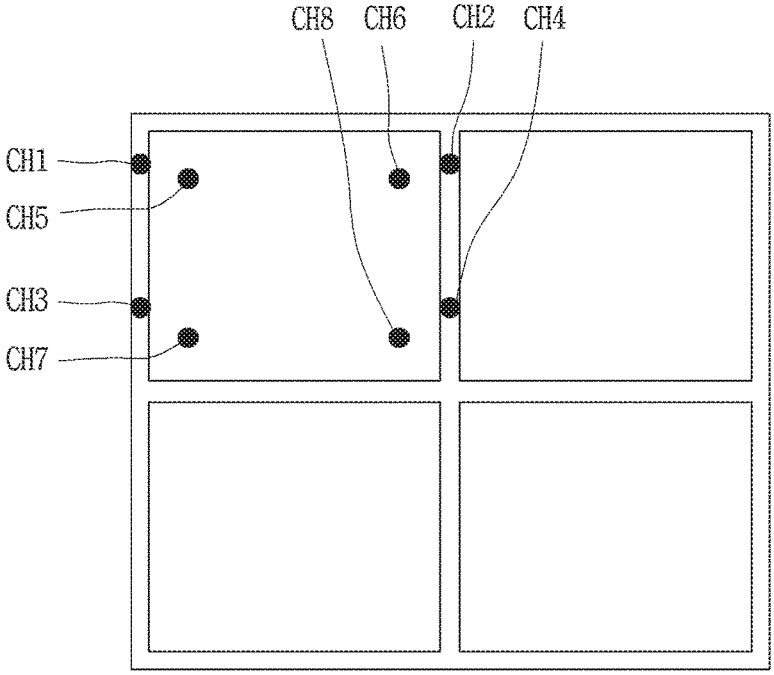
FIG. 10 is a conceptual view for explaining a gasoline combustion test.

In the gasoline combustion test, a temperature difference is shown when each head is sprinkled after 1 minute of combustion using 1 MW gasoline flame. A state in 120 seconds after sprinkling and a state in 280 seconds after sprinkling, which exhibited a sufficient cooling effect by head sprinkling, were compared. Meanwhile, each measurement position is a point on the curtain will frame and the glass surface illustrated in FIG. 10.

TABLE 2

| | E-flush head | | Window sprinkler head | | Glass curtain wall water curtain head | |
|---|---|---|---|---|---|---|
| Measurement position | Temperature 120 seconds after sprinkling (° C.) | Temperature 480 seconds after sprinkling (° C.) | Temperature 120 seconds after sprinkling (° C.) | Temperature 480 seconds after sprinkling (° C.) | Temperature 120 seconds after sprinkling (° C.) | Temperature 480 seconds after sprinkling (° C.) |
| Curtain wall internal upper right side AL frame (CH.1) | 60 | 77 | 59 | 68 | 44 | 47 |
| Curtain wall internal upper right side glass surface (CH.5) | 56 | 65 | 32 | 26 | 41 | 55 |
| Curtain wall internal upper left side AL frame (CH.2) | 42 | 42 | 29 | 36 | 44 | 48 |
| Curtain wall internal upper left side glass surface (CH.6) | 33 | 34 | 17 | 21 | 44 | 54 |
| Curtain wall internal central right side AL frame (CH.3) | 44 | 48 | 36 | 43 | 45 | 47 |
| Curtain wall internal central right side glass surface (CH.7) | 43 | 45 | 11 | 31 | 39 | 44 |
| Curtain wall internal central left side AL frame (CH.4) | 39 | 39 | 37 | 42 | 35 | 40 |
| Curtain wall internal central left side glass surface (CH.8) | 37 | 41 | 41 | 56 | 40 | 57 |

Referring to Table 2 above, it can be seen that a surface temperature cooling effect and a temperature control effect are obtained in the glass curtain wall water curtain head according to the present disclosure.

The present invention described above may be implemented as a computer-readable code in a medium in which a program is recorded. The computer-readable medium includes any type of recording device in which data that can be read by a computer system is stored. The computer-readable medium may be, for example, a hard disk drive (HDD), a solid state disk (SSD), a silicon disk drive (SDD), a ROM, a RAM, a CD-ROM, a magnetic tape, a floppy disk, an optical data storage device, and the like. The computer-readable medium also includes implementations in the form of carrier waves (e.g., transmission via the Internet). Also, the computer may include the controller 180 of the terminal. Thus, the foregoing detailed description should not be interpreted limitedly in every aspect and should be considered to be illustrative. The scope of the present invention should be determined by reasonable interpretations of the attached claims and every modification within the equivalent range are included in the scope of the present invention.

What is claimed is:

1. A water curtain head comprising:

a head body connected to a water supply pipe installed inside a building and having a water releasing opening; and a deflector disposed to be adjacent to the water releasing opening to allow water discharged by the water releasing opening to pass therethrough, wherein the deflector includes:

a first spray nozzle formed on a front surface of the deflector to penetrate through the front surface;

a plurality of second spray nozzles depressed inwards from a side surface of the deflector by a predetermined section; and a cover covering the head body and the deflector, wherein the deflector has a shape of a disk, wherein the plurality of second spray nozzles are formed in a circumferential direction of the disk, wherein the plurality of second spray nozzles are formed only in a partial region excluding an upper region of a circumference of the disk, wherein the deflector is formed to get thicker from center to outside, wherein the deflector is formed to thicken in a direction towards the water releasing opening, and wherein the water releasing opening is configured to discharge water horizontally, wherein the head body includes a first body, and a second body formed in a direction perpendicular to the first body and having the water releasing opening, wherein the first spray nozzle is formed to discharge water in a same direction as the discharge of water from the water releasing opening, wherein the plurality of second spray nozzles are formed to discharge water in a direction perpendicular to the discharge of water from the first spray nozzle, wherein the cover icludes a front surface corresponding to the direction in which water sprayed through the first spray nozzle, and a lower surface formed in a direction perpendicular to the front surface of the cover and corresponds to the direction in which water sprayed through the plurality of second spray nozzles, and wherein the cover includes a first heat sensing hole formed at a position of the front surface of the cover corresponding to the first spray nozzle and a second heat sensing hole formed at a position of the lower surface of the cover corresponding to the plurality of second spray nozzles.

2. The water curtain head of claim 1, wherein a sloped portion is formed on a rear surface of the deflector such that a thickness of the deflector is increased from a center of the deflector toward an edge of the deflector.

3. The water curtain head of claim 1, wherein the head body is provided in a frame, and wherein the frame has a bent portion formed on at least a portion to correspond to a shape of the first and second bodies.

4. The water curtain head of claim 3, wherein a stopper is disposed on an opposite side of the water releasing opening of the second body, and wherein the stopper is coupled to the frame.

5. The water curtain head of claim 3, wherein a connection portion connected to the frame is formed on a rear surface of the deflector.

6. The water curtain head of claim 1, further comprising:

a first cap connected to the deflector;

a second cap disposed at the water releasing opening to close the water releasing opening; and a heat sensing portion configured to sense heat and disposed between the first and second caps.

7. A water curtain head comprising:

a head body connected to a water supply pipe installed inside a building and having a water releasing opening;

a deflector having a spray nozzle allowing water discharged by the water releasing opening to pass therethrough;

a heat sensing portion disposed between the head body and the deflector; and a cover covering the head body and the deflector, wherein the deflector includes a first spray nozzle formed on a front surface of the deflector to penetrate through the front surface of the deflector, and a plurality of second spray nozzles depressed inwards from a side surface of the deflector by a predetermined section, wherein the deflector has a shape of a disk, wherein the plurality of second spray nozzles are formed in a circumferential direction of the disk, wherein the plurality of second spray nozzles are formed only in a partial region excluding an upper region of a circumference of the disk, wherein the deflector is formed to get thicker from center to outside, wherein the deflector is formed to thicken towards the water releasing opening, wherein the water releasing opening is configured to discharge water horizontally, and wherein the head body included:

a first body, and a second body formed in a direction perpendicular to the first body and having the ater releasing opening, wherein the first spray nozzle is formed to discharge water in a same direction as the discharge of water from the water releasing opening, wherein the plurality of second spray nozzles are formed to discharge water in a direction perpendicular to the discharge of water from the first spray nozzle, wherein the cover includes:

a front surface corresponding to the direction in which water sprayed through the first spray nozzle, and a lower surface formed in a direction perpendicular to the front surface of the cover and corresponds to the direction in which water sprayed through the plurality of second spray nozzles, and wherein the cover includes a first heat sensing hole formed at a position of the front surface of the cover corresponding to the first spray nozzle and a second heat sensing hole formed at a position of tee lower surface of the cover corresponding to the plurality of second spray nozzles.

8. The water curtain head of claim 7, wherein the cover is coupled to a first fixing portion, and wherein the cover is coupled to the first fixing portion by a heat sensing alloy such that the cover is separated from the first fixing portion when an ambient temperature of the cover is equal to or higher than a predetermined temperature.

9. The water curtain head of claim 8, wherein a hook is formed on at least one of the first fixing portion and a second fixing portion and a recess is formed on another of the first fixing portion and the second fixing portion to allow the hook to be hooked therein so that the first and second fixing portions are coupled to each other.

10. A curtain wall water curtain head system applied to a curtain wall building, the curtain wall water curtain head system comprising:

a curtain wall; and the water curtain head according to claim 1, the water curtain head installed to be adjacent to the curtain wall, wherein the front surface of the deflector faces the curtain wall such that water sprayed through the first spray nozzle is oriented toward the curtain wall.

* * * * *